United States Patent [19]

Doderer et al.

[11] Patent Number: 4,708,706

[45] Date of Patent: Nov. 24, 1987

[54] APPARATUS FOR SHAPING WRAPPERS FOR PACKAGES

[75] Inventors: Gerhard Doderer, Marbach/Neckar; Heinz Kiefer, Stuttgart; Willi Krieger, Korb, all of Fed. Rep. of Germany

[73] Assignee: Robert Bosch GmbH, Stuttgart, Fed. Rep. of Germany

[21] Appl. No.: 905,202

[22] Filed: Sep. 9, 1986

[30] Foreign Application Priority Data

Nov. 27, 1985 [DE] Fed. Rep. of Germany ..... 3541821

[51] Int. Cl.[4] ..... B31B 31/28; B31B 35/32

[52] U.S. Cl. ..... 493/295; 493/164; 493/252

[58] Field of Search ..... 493/163, 164, 175, 176, 493/250, 251, 252, 143, 166, 167, 174, 295, 456, 457, 466

[56] References Cited

U.S. PATENT DOCUMENTS

| | | | |
|---|---|---|---|
| 2,168,543 | 8/1939 | Vergobbi | 493/164 |
| 3,018,702 | 1/1962 | Bauder | 493/164 |
| 3,140,643 | 7/1964 | Barthelmess | 493/191 |

*Primary Examiner*—Frederick R. Schmidt
*Assistant Examiner*—William E. Terrell
*Attorney, Agent, or Firm*—Edwin E. Greigg

[57] ABSTRACT

A package wrapper shaping apparatus which has lateral folders and folding slides for wrapping a blank around a shaping mandrel. In order to guide the free portions of the blank in a defined manner in this process and to put their outer edge portions on one side of the shaping mandrel in contact with one another, the lateral folders and the folding slides are embodied in comb-like fashion with teeth, so that they mesh alternately with one another in pairs as they fold over the end portions of the blank.

6 Claims, 4 Drawing Figures

APPARATUS FOR SHAPING WRAPPERS FOR PACKAGES

BACKGROUND OF THE INVENTION

The invention is based on a wrapper shaping apparatus for packages. An apparatus of this kind known from German Pat. No. 694 305 and U.S. Pat. No. 3,140,643 has lateral folders, of which the folding edge in the upper position of the lateral folders is located in approximately the same plane as the top of the shaping mandrel, with air blower nozzles assigned to them. The air blower nozzles blow streams of air at the initially horizontally oriented side portions of the blank, thereby wraping them against the side walls of the shaping mandrel as the lateral folders move upward. The outer portions of the blank, which wrap around the top of the shaping mandrel, are also supposed to be set upright, out of their horizontal position, by the blown air streams so that the folding slides will grip these portions of the blank securely. The ends of the blank that are to be folded over are relatively unstable in shape, especially when the blank is made of a relatively non-rigid packaging material such as paper or thin foils, which means there is a danger that creases will be formed. This danger is especially great when the folding devices operate at high speed. Accordingly, there is a need for a wrapper shaping apparatus in which the blank is guided in a defined manner as it is being folded about the shaping mandrel, especially when its end portions are being folded over.

OBJECT AND SUMMARY OF THE INVENTION

The wrapper shaping apparatus according to the invention has the advantage over the prior art that the blank is folded about the shaping mandrel using stable shaping tools, and the individual portions of the blank always assume a defined position, so that the folder slides, which finally fold the end portions over onto the top of the shaping mandrel, engage the end portions of the blank while the are extended flat. As compared with an apparatus aided by blown air, it has the further advantage that a supply apparatus and a control apparatus for blown or compressed air can be dispensed with, and so its structure is simple and operating costs are low.

The invention will be better understood and further objects and advantages will become more apparent from the ensuing detailed desription of preferred embodiments taken in conjunction with the drawings.

BRIEF DESRIPTION OF THE DRAWINGS

DESCRIPTION OF THE PREFERRED EMBODIMENTS

Figure 2:
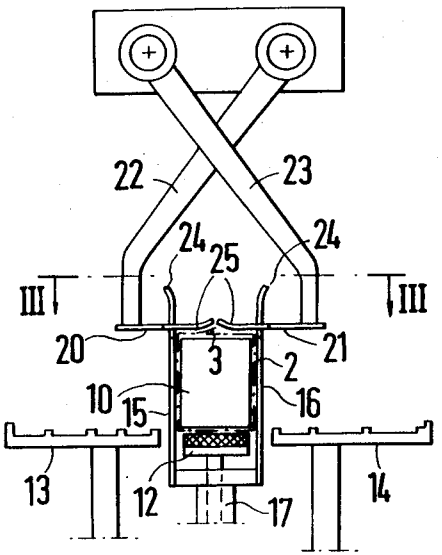
FIG. 2 is a front view of the wrapper shaping apparatus of FIG. 1 in a second operating position.

Reference numeral 10 indicates one of a plurality of shaping mandrels, which are secured in a radially offstanding manner on a shaping mandrel holder, such as a wheel, which is rotated in increments about a vertical axis. The shaping mandrels are moved in succession to the various work stations of a bag making machine. In the wrapper shaping station, a table which comprises a die 12 matching the shaping mandrel 10 and two lateral table platforms 13, 14 is movable up and down below a ready-to-use shaping mandrel 10 for receiving and presenting a flat blank 1 of packaging material. Between the die 12 and the two table platforms 13, 14, two lateral folders 15, 16 extend in the two planes of the lateral faces of the shaping mandrel 10 and are secured to a stem 17 that is movable up and down. The height of the lateral folders 15, 16 is such that in the upper position (FIG. 2), in which the lateral folders cover the two side walls of the shaping mandrel, their upper edges protrude beyond the top of the shaping mandrel 10. Preferably the protruding portion of the lateral folders 15, 16 is somewhat higher than half the width of the top of the shaping mandrel 10. Above the shaping mandrel 10, two folding slides 20, 21 are pivotable on arms 22, 23 onto the top of the shaping mandrel 10.

To enable the two lateral folders 15, 16 to guide the end portions of the blank 1 out past the top of the shaping mandrel 10 and erect them, and to enable the two folding slides 20, 21 to fold these end portions over onto the top of the shaping mandrel 10, the lateral folders 15, 16 and the folding slides 20, 21 are embodied in comb-like fashion. The lateral folders 15, 16 and the folding slides 20, 21 each have a plurality of teeth 24, 25 extending in their direction of movement, with gaps between the teeth; the width of the teeth and the width of the gaps are approximately the same. The teeth 24 of the two lateral folders 15, 16 are each offset with respect to the teeth 25 of the folding slides 20, 21, so that in the final folding position (FIG. 2) the teeth 24 of the lateral folders 15, 16 and the teeth 25 of the folding slides 20, 21 mesh with one another. The teeth 24 of the lateral folders 15, 16 extend in the portion that protrudes beyond the top of the shaping mandrel and their height is somewhat greater than half the width of the top of the shaping mandrel 10.

Figure 1:
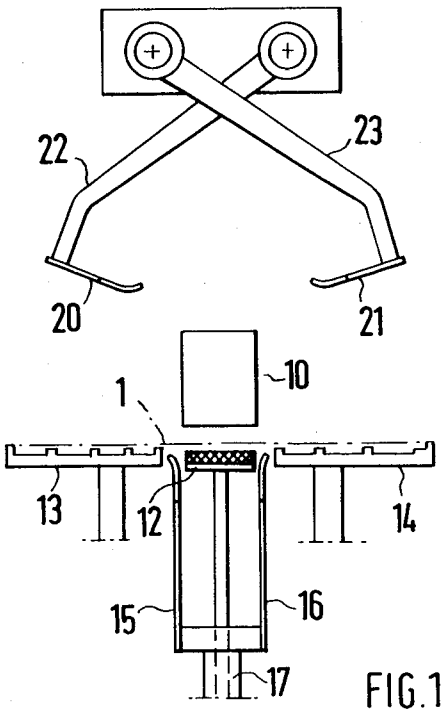
FIG. 1 is a front view of a first exemplary embodiment of a wrapper shaping apparatus shown in simplified form.

The wrapper shaping apparatus described above functions as follows:

In the initial position, in which the two folding slides 20, 21 are pivoted away from the shaping mandrel 10, the lateral folders 15, 16 are located below the underside of the shaping mandrel 10, and the two table platforms 13, 14 and the die 12 assume a position that is spaced apart by a predetermined distance from the underside of the shaping mandrel 10, a blank 1 of some foldable packaging material is delivered to the two table platforms 13, 14 and the die 12 (FIG. 1). After that, the two table platforms 13, 14 and the die 12 are moved upward, until the die 12 presses the blank 1 firmly against the underside of the shaping mandrel 10. The lateral folders 15,16 are also moved upward, in the course of which they move along the portions of the blank 1 that are offstanding from the shaping mandrel 10 and apply them to the side walls of the shaping mandrel 10, and with their teeth 24 that are moved upward past the top of the shaping mandrel 10 they erect the end portions upright in a defined manner past the top of the shaping mandrel 10.

After that, first the right-hand folding slide 21 pivots toward the top of the shaping mandrel 10, in the course of which, with its teeth 25, it folds the end portion of the blank 1 which has been erected by the right-hand lateral folder 16 over onto the top of the shaping mandrel 10.

Then the left-hand folding slide 20 pivots toward the top of the shaping mandrel 10, in the course of which it folds the end portion of the blank 1 which has been erected by the left-hand lateral folder 15 over onto the top of the shaping mandrel 10 and onto the outermost edge of the end portion that had been folded over previously, while the folding slide 21 is already pivoting backward again, so that a wrapper 2 which has an overlapping seam 3 is formed. Adhesive tha has been applied beforehand to the edge of the blank joins the two overlapping edges of the blank 1. At this stage the blank is sealed along one side to form a tubular wrapper with open ends. After the lateral folders 15, 16, the table platforms 13, 14 and die 12 and the folding slides 20, 21 have all been retracted, the shaping mandrel 10 having the wrapper 2 is indexed on to the next processing station, where a bottom is shaped onto the wrapper 2 opposite the free end of the mandrel. The wrapper is then removed from the mandrel and will have an open end for receipt of appropriate goods.

Figure 3:
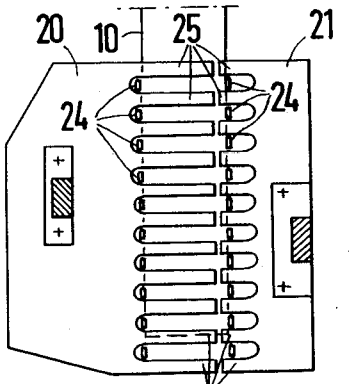
FIG. 3 is a plan view of the wrapper shaping apparatus in the plane III—III of FIG. 2.
Figure 4:
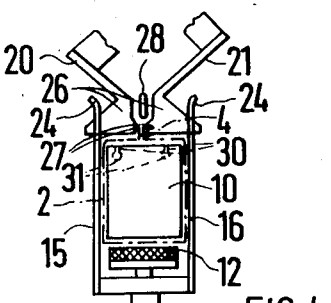
FIG. 4 is a front view of a second exemplary embodiment of a wrapper shaping apparatus shown in simplified form.

Deviating from the above exemplary embodiment, in which wrappers 2 having an overlapping seam 3 are formed, the exemplary embodiment of FIG. 4 is designed for shaping wrappers 2 having an offstanding protruding seam 4. To this end, the wrapper shaping apparatus of FIG. 4 is embodied identically to that of FIGS. 1–3, except for the folding slides. Here, the folding slides 20, 21, instead of being platform-like, are embodied with block-like teeth 26. The teeth 26 have faces 27 on their front side (as viewed in the folding direction), withwhich they guide the outer edge portions of the blank, which have been erected with the lateral folders 15, 16, toward one another; the insides of these edges of the blank first reach a folder blade 28 and then slip off, so that their outermost edge portions face one another, inside to inside, touching one another, and are pressed by the faces 27 of the teeth 26. Suction bores 30, whcih open onto the top of the shaping mandrel 10 and communicate via collecting bores with a vacuum source, hold the portions of the blank that have been folded over onto the top of the shaping mandrel 10 in this position, until the protruding seam 4 is heat-sealed or fused by a welding device in a subsequent station. In this exemplary embodiment as well, the teeth 26 of the folding slides 20, 21 fit into the gaps between the teeth 24 of the two lateral folders 15, 16.

The foregoing relates to preferred ememplary embodiments of the invention, it being understood that other variants and embodiments thereof are possible within the spirit and scope of the invention, the latter being defined by the appended claims.

What is claimed and desired to be secured by Letters Patent of the United States is:

1. An apparatus for shaping wrappers for packages from a blank of foldable packaging material, having a shaping mandrel (10), having a table for receiving a flat blank (1), a die (12) that forces a portion of said flat blank against one side of said shaping mandrel that includes side walls, two lateral folders, (15, 16) that are movable from a lower position to an upper position alongside said die to erect side portions of the blank upward against the side walls of said shaping mandrel, two folding slides (20, 21) that move relative to each other to folding positions to fold portions of the blank that protrude beyond the shaping mandrel over onto a top side of the shaping mandrel, said lateral folders (15, 16) and folding slides each being of comblike fashion including teeth (24, 25, 26) with gaps therebetween, the teeth of the lateral folders when said laterial folders are in an upper position protruding beyond the top of the shaping mandrel, and the folding slides when in their folding position have their teeth in altelrnating meshing engagement with the teeth and gaps of said lateral folders in their upper positions.

2. An apparatus as defined by claim 1, in which said teeth (24) of said lateral folders (15, 16) have a height which is greater than half the width of the top of the shaping mandrel (10).

3. An apparatus as defined by claim 2, in which said teeth (26) of the folding slides (20, 21) are block-like in embodiment.

4. An apparatus as defined by claim 2, in which said teeth (25) of said folding slides have a length which is greater than one-half the width of the top of said shaping mandrel.

5. An apparatus as defined by claim 1, in which said teeth (26) of the folding slides (20, 21) are block-like in embodiment.

6. An apparatus as defined by claim 1, in which said teeth (25) of said folding slides have a length which is greater than one-half the width of the top of said shaping mandrel.

* * * * *